United States Patent [19]

Kovacs

[11] 4,255,912

[45] Mar. 17, 1981

[54] TEMPORARY SHELTER

[76] Inventor: Jozsef M. Kovacs, 335 Kensington Ave., Montreal, Quebec, Canada, H3Z 2H2

[21] Appl. No.: 82,044

[22] Filed: Oct. 5, 1979

[30] Foreign Application Priority Data

Jun. 8, 1979 [CA] Canada ..... 329389

[51] Int. Cl.[3] ..... E04H 1/00

[52] U.S. Cl. ..... 52/79.8; 52/222; 52/741

[58] Field of Search ..... 52/79.1, 79.7, 234, 52/63, 222, 79.8, 741, 143

[56] References Cited

U.S. PATENT DOCUMENTS

| | | | |
|---|---|---|---|
| 2,841,832 | 7/1958 | Couse et al. | 52/234 X |
| 3,678,639 | 7/1972 | Panitz | 52/79.1 |
| 3,717,965 | 2/1973 | Morten et al. | 52/79.1 |

FOREIGN PATENT DOCUMENTS

| | | | |
|---|---|---|---|
| 1432576 | 2/1966 | France | 52/79.1 |

*Primary Examiner*—Price C. Faw, Jr.
*Assistant Examiner*—Carl D. Friedman
*Attorney, Agent, or Firm*—Robic, Robic & Associates

[57] ABSTRACT

Method for the construction of a temporary shelter, comprising an even number of base modules of equal size each having an entrance at one end, the base modules being placed side by side in two rows with the base modules of one row facing in pairs those of the other row so as to form a hallway, the entrances opening into the hallway. Floor modules having the same width as the hallway are located between the pairs of facing base modules so as to join them at the bottom thereof. Two vestibule-forming modules having the same width as the floor modules are provided at the ends of the hallway so as to close it. The base modules are joined together by means of a first set of thin sheets of flexible sealing material each being removably secured between the front, the top and the rear walls of the base modules. A double sealing roof is removably secured over the hallway along the full length thereof, this double roof comprising a first wide sheet of flexible material having substantially the width of the hallway and spreading above it between the upper ends of the front walls of the base modules, and a second wide sheet of sealing material having a width greater than that of the hallway and spreading between the top walls of the base modules in order to sealingly insulate the hallway. A second set of thin sheets of flexible sealing material is removably secured to the base modules and to the vestibule modules so as to join them together.

15 Claims, 8 Drawing Figures

TEMPORARY SHELTER

The present invention relates to a method for constructing a temporary shelter on a selected site by the simple and fast assembly of easily transportable modular components or elements.

The invention also relates to the temporary shelter obtained by the aforesaid construction method.

It is known that geological, petroleum, forestry or the like exploration in remote and isolated areas for the purpose of taking samples, soundings or, more generally, collecting scientific information, require the building of shelters on the site for housing employees and material. Because of their use, these shelters are obviously of a temporary nature since their construction and dismantling are directly tied to the results of the exploration and since they must be capable of being easily transported and installed in very different sites which are often inaccessible by ground travel, in accordance with the research requirements.

Of course the best known type of temporary shelter is the camping tent which can easily be transported and installed. However, this type of shelter has very big inconveniences such as offering very little comfort, being rarely sanitary and being further hardly safe, particularly in inhospitable regions as, for example, the Canadian Far North.

In order to avoid the inconveniences of camping, particularly when the exploration tends to be prolonged in one location, it is often necessary to build, on site, more or less temporary huts in order to offer at least a minimum of comfort to the exploration personnel.

This technique which is in use by almost every public or private corporations, including the Armed Forces, not only require the transportation of the huts piece by piece on the site but also the transportation of a specialized crew to assemble the huts. This is obviously extremely costly in time, in men and often in material since, once built, the huts are no longer transportable and are generally abandoned when the exploration is finished.

The present invention proposes a method of constructing a temporary shelter which tends to cope with the aforementioned disadvantages.

More specifically, an object of the invention is a method of constructing a temporary shelter making it possible to rapidly and at low cost install safe living quarters that are comfortable and sanitary and that may be used from the first day of the arrival of the personnel and that may easily be recuperated for later reuse.

The construction method calls for modular elements that can be transported by helicopters and that can be joined together for a specific purpose such as the building of a dormitory, of an office, of a kitchen etc. without any mechanical fastening system and, consequently, without the use of tools.

The use of modular elements that can easily be transported by aircraft, by helicopter or over the ground is not in itself original. In fact, the complete originality of the present invention resides in the manner in which the various modules are joined together thanks to a fastening system which is simple and flexible, made up of sheets of flexible sealing material such as plastic foils that can easily be secured to the modules as, for example, by hooks and a lace. This fastening system has the advantage of not only being extremely simple, which facilitates the assembly of modules without requiring any specialized personnel, but also copes with the traditional problem encountered during the assembly of prefabricated components, that is, the provision of sealing joints capable of resisting deformation or distortion of the assembly. Thus, if for one reason or another, freezing or thawing or any other similar occurrence cause the assembly to move, the flexible sheets joining the modules follow the distortion without damaging the individual structure of each module while retaining their sealing property.

The method of constructing a temporary shelter, according to the invention, comprises the simple and fast assembly, on a selected site, of a set of easily transportable modular elements comprising an even number of base modules or having the same size and each provided with an entrance at one end, at least one floor module, and two vestibule-forming modules having substantially the same width as each floor module. The method is carried out by first placing the base modules side by side in two rows with the base modules of one row facing, in pairs, those of the other row so as to form a hallway having the same width as that of the floor module, with the entrances of each base module opening into the hallway. Thereafter, each floor module is placed between each pair of base modules in such a way as to join them at the base and the two vestibule modules are then placed at the ends of the hallway thereby closing it. Thereafter, the adjacent base modules on the same side of the hallway are joined by means of a thin sheet of flexible sealing material removably and rapidly secured on the front, top and rear walls of each base module. There is likewise formed a double sealing roof over all of the length of the hallway by removably and rapidly securing a first wide sheet of flexible material having substantially the width of the hallway, which sheet extends above the hallway between the upper ends of the front walls of the base modules, and a second wide sheet of flexible sealing material having a width greater than that of the hallway, which second sheet extends above the first one between the top walls of the base modules in order to sealingly insulate the hallway. Finally, the vestibule modules are joined to the base modules and to the double sealing roof at the ends of the hallway by means of thin sheets in the same manner as each pair of adjacent base modules have been joined together.

In accordance with a preferred embodiment of the invention, a row of equally spaced bows are provided above the hallway between the ends of the top walls of the base modules located face to face prior to securing the second wide sheet of the double sealing roof and the latter is thereafter placed over the bows before securing it to the base module whereby to allow gravity flow of rain water and snow falling over the double roof on either side of the hallway.

According to another embodiment of the invention, the thin sheets serving to join the base modules and the vestibule modules as well as the wide sheets forming the double sealing roof are secured by means of laces that wind about hooks provided for that purpose on the base modules and on the vestibule modules. Preferably, the laces used for securing the thin sheets pass through a row of eyelets extending over the full width of each of the edges of the thin or wide sheets.

According to a third embodiment, thin shimming slats are secured near the hooks provided on the base modules and on the vestibule modules in such a manner as to slightly raise the thin sheets to avoid water infiltration.

As previously mentioned, the main advantage of this method resides in the fact that it makes it possible to rapidly and at low cost raise safe, comfortable and sanitary living quarters that may be used the very first day of the arrival of the personnel on the site and be easily recuperated for later use. Indeed, each base module may be constructed in such a way that it may be used alone, with its own heating and ventilation system. Each thus constructed base module may serve immediately as a room, as a shower room, as a dining room, as a pumping station, as an office or as a warehouse. In each such case, the base module remains the same and does not require any modification to be assembled with other identical modules as explained above.

The temporary shelter according to the invention as obtained by carrying out the above-mentioned method, comprises a number of base modules all having the same size and each provided with an entrance at one end. These modules are arranged face to face and side by side on the selected site in such a manner as to define a hallway with the entrances of each module opening onto the hallway.

The temporary shelter according to the invention further comprises at least one floor module of which the width is the same as that of the hallway, which is located between each pair of facing base modules in such a manner as to join them at the base, as well as two vestibule-forming modules having substantially the same width as that of the floor module. The two vestibule modules are located at each end of the hallway so as to close it.

The temporary shelter according to the invention also includes a first set of thin sheets of flexible sealing material each removably secured between the front, top and rear walls of the base modules in such a way as to join them, as well as a double sealing roof removably secured over the hallway along the full length thereof. This double roof comprises a first wide sheet of flexible material generally having the same width as that of the hallway, which spreads above the latter between the upper ends of the front walls of the base modules and a second wide sheet of flexible sealing material having a width greater than that of the hallway and spreading between the top walls of the two base modules in order to sealingly insulate the hallway.

Finally, the temporary shelter according to the invention comprises a second set of thin sheets made of flexible sealing material removably secured to the base modules and to the vestibule modules in order to join them together.

The invention as well as its advantages will be better understood from the following description of a preferred embodiment thereof having reference to the appended drawings wherein.

Figure 1:
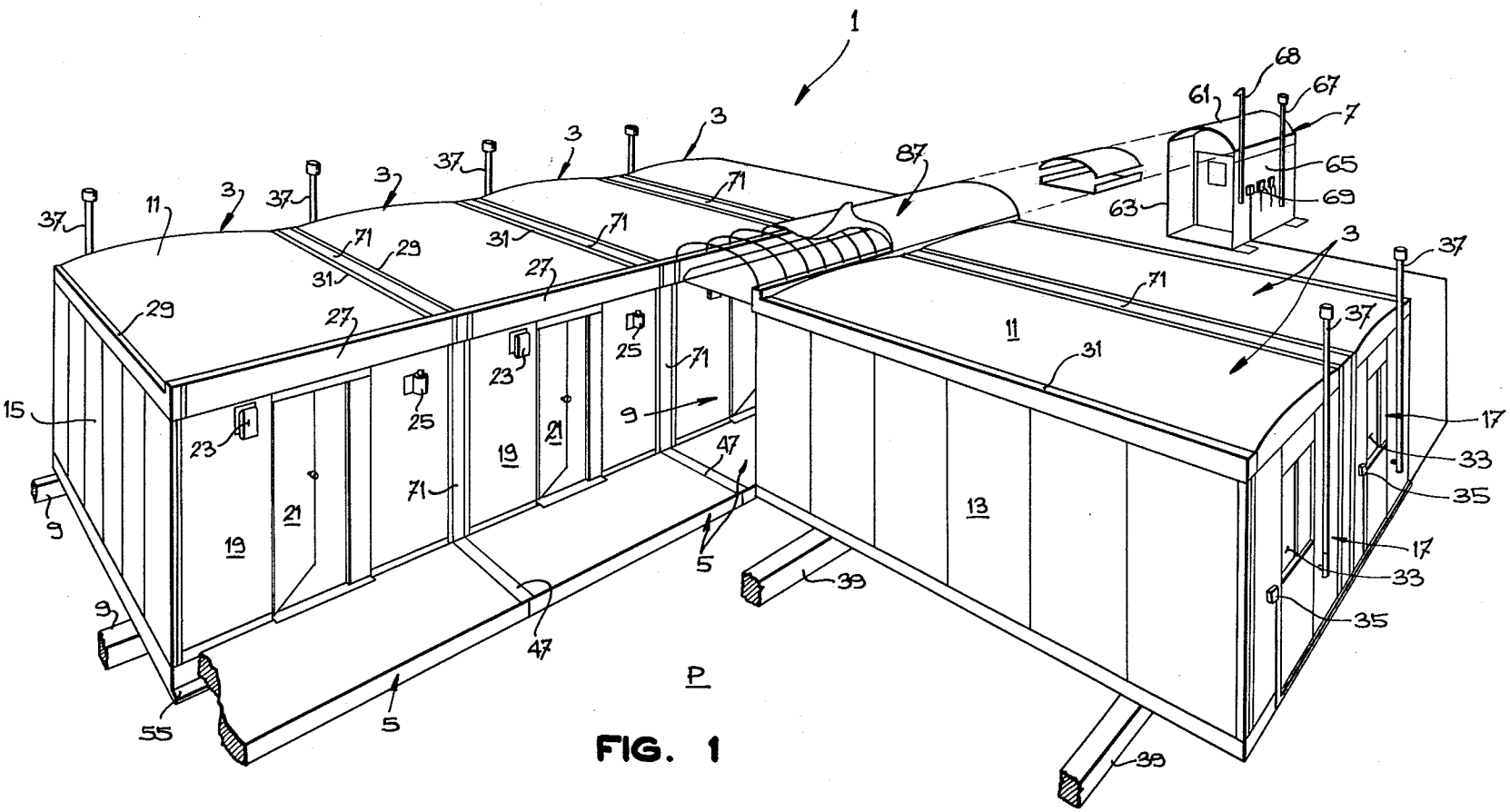
FIG. 1 is a perspective view of a temporary shelter made according to the invention and shown during installation.
Figure 2:
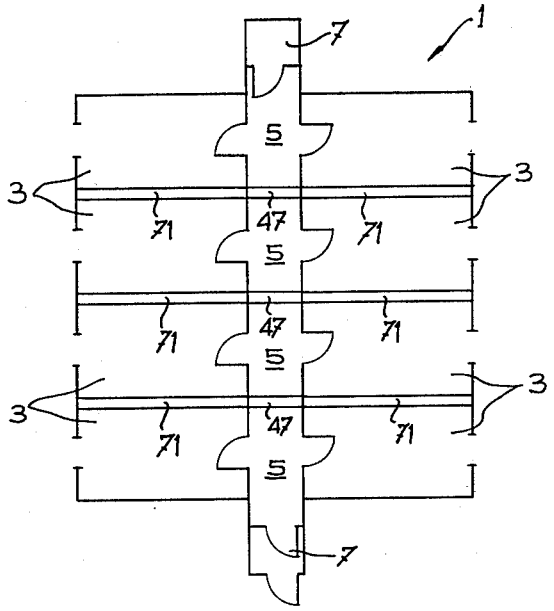
FIG. 2 is a schematic plan view of the temporary shelter illustrated in FIG. 1, once fully constructed.

The temporary shelter 1 shown in the very general view of FIG. 1 comprises an assembly of easily transportable modular elements. By easily transportable modular elements is to be understood any element that can be transported by aircraft, helicopter or over the ground, that is every modular element of which the weight and volume are sufficiently restricted to be transported by helicopter or bush aircrafts of conventional structure such as Bell 205, Sikorsky or Hercule. Thus, the weight of each module can be in the order of 3,000 pounds for dimensions in the order of 9 ft×9 ft×18 ft.

The modular elements used for the construction of the temporary shelter 1 are constituted by an even number of base modules 3, at least one floor module 5 and two vestibule-forming modules 7.

All the base modules 3 have generally the same parallelepipedic shape and are all of the same size which, as indicated previously, is selected in such a manner as to facilitate transportation by air. Each base module 3 comprises a top wall 11, slightly convex to allow for rain water flow, two sidewalls 13 and 15, a rear wall 17 and a front wall 19. These walls are assembled to the same floor (not shown) directly in a prefabricating plant and are made up of structural sandwich panels having an outer steel sheathing on the top wall and beneath the floor and an aluminum sheathing over the side, front and rear walls.

Each base module is conceived to be completely self-contained in order that it may be used immediately once dropped on the floor by helicopter, aircraft or truck. Because of this, each module 3 has independent heating and ventilation systems that only require to be connected to an outer energy source such as an electrical generator.

The front wall 19 of each base module has, at its center, an entrance door 21 and, on either side of this entrance, an aeration outlet 23 as well as an emergency light 25. The front wall 19 is provided at the top with a lintel 27 of which the structure and the use are described hereinafter.

The rear wall 17 of each base module has, at its center, a window 33 and, on either side of this window, an outer electrical outlet 35 as well as a chimney 37 for the heating system.

Of course, each base module is perfectly insulated against the cold as well as against the heat. This insulation is particularly interesting since, by simply changing the heating system by an air-condition system, the same module may be used in extremely cold regions such as the Canadian Far North, as well as in extremely hot and tropical regions such as the African deserts.

The aforedescribed base modules 3 which are necessary for the installation of a temporary shelter according to the invention are transported on the selected site by aircraft, helicopter or truck. The selected sites may be prearranged so as to provide a flat surface P. The latter, which serves as a foundation for the temporary shelter, may be constituted by the ground itself, by the snow or by the ice, or by tree stumps sawed at the same level.

The base modules 3 are disposed face by face and side by side on the flat surface P in such a manner as to form together a hallway 9 having a predetermined width which can be a few feet. The base modules 3 arranged on either side of the corridor need not be placed one against the other. To the contrary, it is preferable to leave a space of a few inches between each one in order to allow a certain deformation or distortion of the shelter assembly to prevent it from being damaged.

Preferably, the base modules 3 that are located on the same side of the hallway are disposed one next to the other on two beams 39 that have previously been laid over the flat surface P. These beams 39, that may for instance be 8×8 inch wood beams, are used to raise the modules slightly above the ground and allow them to be anchored by means of any appropriate anchoring means, not shown.

Once anchored on the beams 39, the base modules 3 are joined together at the level of their floor by means of modules 5 hereinafter more generally designated by the name floor modules.

Figure 5:
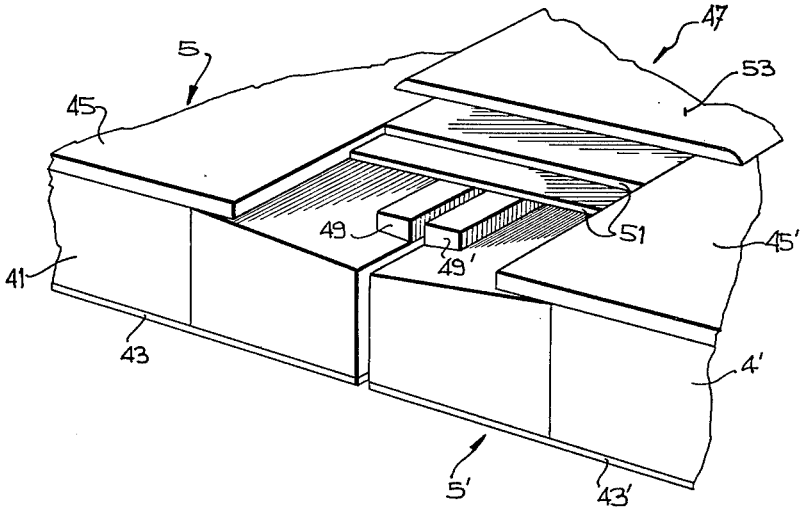
FIG. 5 is a perspective view showing a floor module being installed.

Each floor module 5 is preferably constituted by a rectangular sandwich panel comprising an insulating blanket 41, a lower galvanized steel sheath 43 and a top covering 45 made up of texturized rubber pads on plywood (FIG. 5).

The size of each module 5 is such as to connect the floors of each pair of facing modules 3. For this purpose, each floor module 5 has the width selected for the hallway 9 and the length of each front wall 19 of the base modules 3.

When several base modules are arranged side by side on the same side of the hallway 9 in order to increase the length of the latter, several floor modules 5 have of course to be used. These floor modules are then connected by means of joints 47 an example of which is shown in FIG. 5.

As shown, each joint 47 may comprise two sealing strips 49 and 49' respectively secured to the ends of contiguous floor panels 5 and 5' on the downwardly inclined top faces of the terminal transverse wood members of the panels 5 and 5'. One or two plywood sheets 51 are mounted over the sealing strips 49, 49', such plywood sheets 51 being covered by an overlapping jointing sheath 53 also bearing along the bordering edges of the top covering sheaths 45, 45' of the modules 5, 5'.

Referring more particularly to FIG. 1, and in order to facilitate the installation of the floor modules 5, each base module 3 may advantageously be provided with a support 55 over which the lateral edges of the floor modules 5 rest. This support 55 may be provided by the horizontal flange of an L-beam secured along the lower edge of the front wall 19 of each base module, beneath the door entrance 21. The use of such edge supports makes it possible to install the floor panels 5 simply by depositing it on the horizontal flanges of the supports 55 thus provided on either side of the hallway 9, this installation not requiring any preliminary operation.

Once the floor modules have been mounted in the manner mentioned above, the two vestibule modules 7 are then installed so as to close the two ends of the hallway 9.

The vestibule modules 7 both have the same shape and are conceived in such a way as to have substantially the same width as that of the floor modules 5 whereby to effectively close the ends of the hallway 9. Each module 7 comprises a top wall 61 outwardly curved or convex so as to allow gravity flow or rain water on either side of the sidewalls 63 and 65. As in the case of the base modules, the vestibule modules 7 come with a non-illustrated floor provided directly at the prefabrication plant and are formed with structural sandwich panels having an outer aluminum covering or sheathing and an inner plywood wall sheathing covered with an enameled aluminum sheath.

Also as for the other modules, each vestibule module is likewise prefabricated to be entirely self-contained so that it may readily be used as access to the hallway 9 and to the rest of the temporary shelter 1 as soon as the latter has been installed. Therefore, each module 7 is provided with a set of two doors made according to the usual standards followed for entrances to permanent buildings and is provided with independent heating and ventilation systems. Each module 7 may also be provided with a post 68 serving to connect a main electrical inlet 69 to an outer source of electricity thereby providing electricity to the various electrical outlets 35 of the base modules 3. Each module 7 has its own chimney 67.

As is the case with the base modules 3, the modules 7 closing the hallway 9 may be mounted on ground resting beams to which they may be anchored, the latter being in turn anchored to the flat surface P.

Figure 3:
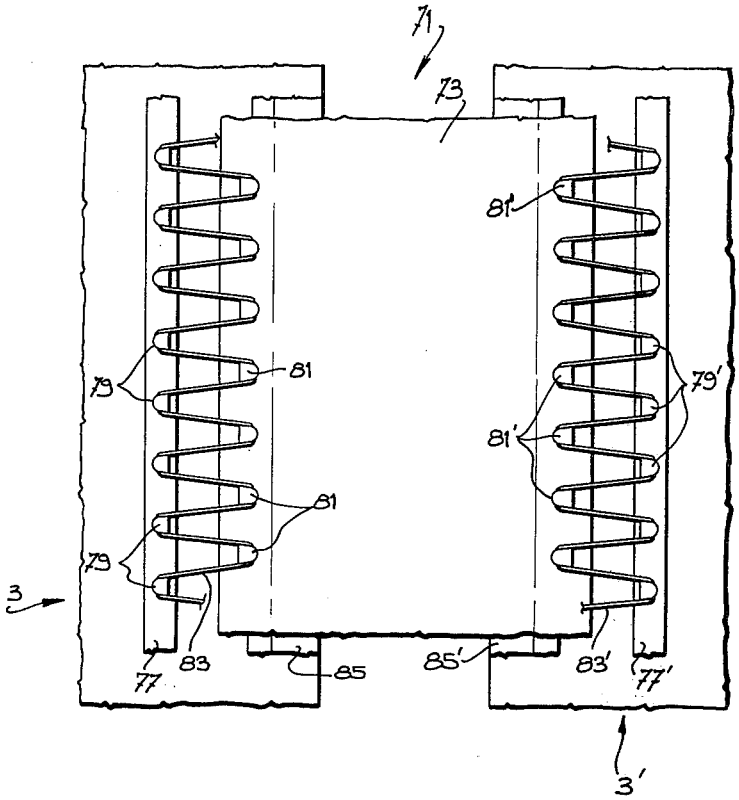
FIG. 3 is a partial front view of a system for fastening together base modules.
Figure 4:
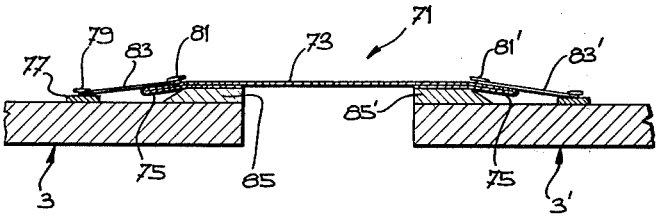
FIG. 4 is a side elevation view of the fastening system of FIG. 3.

Once the module arrangement is completed, the base modules 3 and the vestibule modules 7 are joined together by means of a fastening system 71 which will hereinafter be described in more detail with particular reference to FIGS. 3 and 4.

This fastening system 71 is essentially made up of a sheet of flexible sealing material which may be a simple plastic sheet 73 provided with reinforcing hems 75 along the full length of its edges. This sheet 73 is secured for fast removal over the full length of the front wall 19, the top wall 11 and the rear wall 17 of each base module by means of a simple securing system consisting of a series of hooks and laces such as those used for mountain boots.

This securing system comprises a set of aluminum strips 77 secured over each base module and provided with extruded hooks 79. These aluminum strips extend over the full height of the front panels 19 and along the full length of the edges of the top and rear panels 11 and 17, respectively. The plastic sheet 73 has a corresponding number of hooks 81 secured along the full length of the hems 75 in alternance with the extruded hooks 79. The hooks 81 serve to secure the sheet 73 to the base modules 3 by means of a lace 83 which is tightened between the hooks 79 and 81 over the full length of the front walls 17, the length of the top walls 11 and the height of the rear walls 19.

This system is extremely simple and particularly advantageous because it makes it possible to asemble the base modules 3 together without necessitating any skilled labor. This system is likewise very advantageous in that it makes it possible to obtain a sealing joint capable of resisting a deformation or distortion of the assembly. Indeed, if for one reason or another, the base modules 3 move with respect to one another, the sheet 73 and the laces 83 may easily follow the deformation or distortion without damaging the individual structure of each base module while retaining the sealing property of the joint. The worst that may happen is that the laces 83 may break but they may easily be replaced by other laces that will be wound about the hooks 81 and 79.

In order that the fastening system 71 may retain a certain sealing effectiveness, over the full height of the hallway 9, each base module may be provided with thin shimming slats 85 provided close to the row of hooks 77 along the edges of the front walls 19 of the modules. These slats 85 cause the sheet 73 to rise slightly and bulge outwardly thereby avoiding water infiltration on either side thereof.

Such slats 85 may likewise be used for raising the sheet 73 along the length of the edges of the top walls 11 and of the rear walls 17 of the base modules 3 which are exposed to weathering. However this is not absolutely essential since perfect sealing is not required outside the hallway. In fact, the sheet 73 on the roof only serves to hold snow back to avoid damages that an accumulation would cause between the sidewalls of the modules. Rain water may however flow without risk on the sidewalls of the modules to fall on the ground P.

Instead of using hooks 81 to secure the sheet 73, eyelets may be used through which the lace 83 may pass. This variant of course gives the same result since it makes it possible to secure the lace 83 to the hooks 79 provided on the very modules and tighten the lace 83 at will.

Preferably, the sheet 73 used to join two base modules 3 will have a length such that it can cover the full length of the three walls to be connected. In this respect, it may be noted that there is no particular advantage in joining together the floors of adjacent base modules since that portion of the modules is, by its very position, protected from weathering.

While the above description only mentions how the base modules are joined together, it is obvious that the same fastening system may be used to secure the base modules located at the end of the hallway 9 with the adjacent vestibule modules 7.

In order to complete the installation of the temporary shelter 1, it is necessary to cover hallway 9 by means of a roof 87 easily and removably installed.

Figure 6:
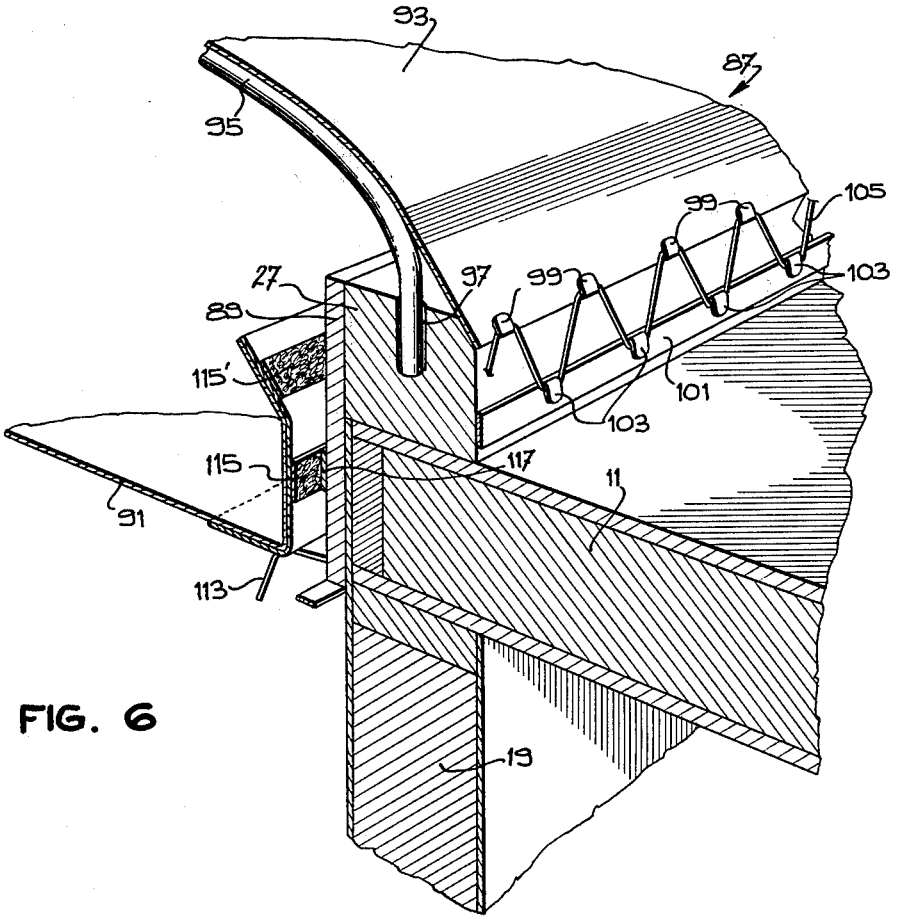
FIG. 6 is a partial perspective view illustrating the fastening system for the double roof.
Figure 7:
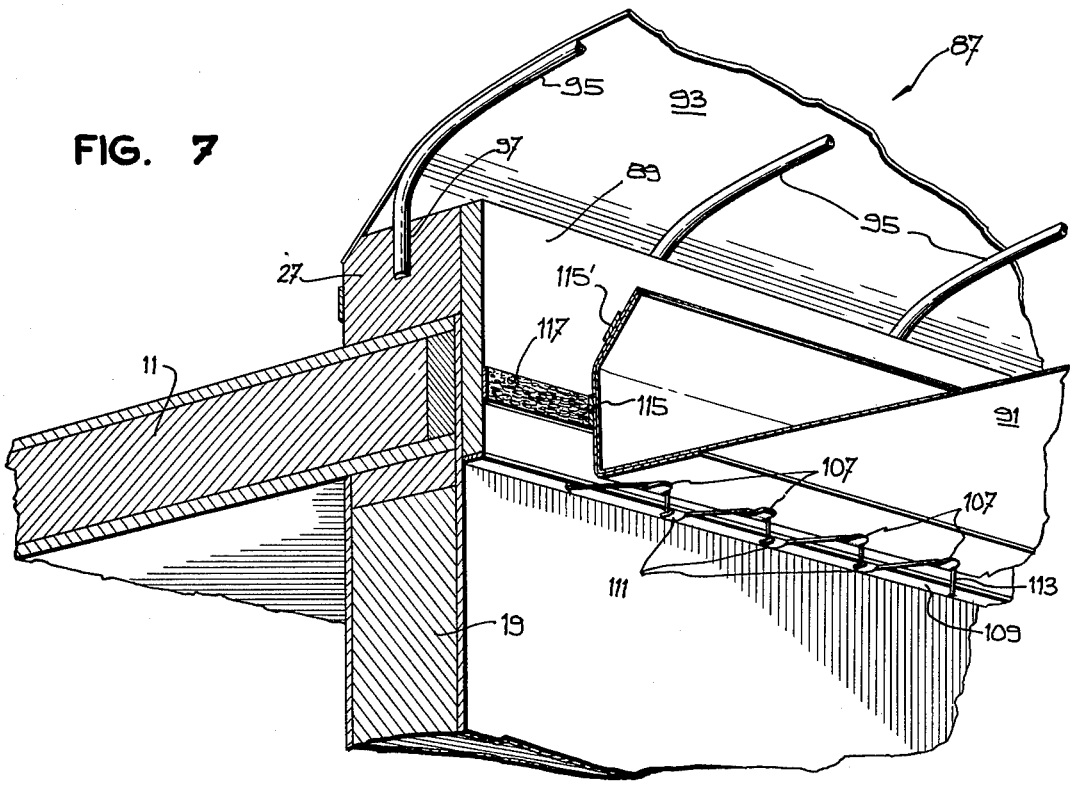
FIG. 7 is a perspective view similar to that of FIG. 6.
Figure 8:
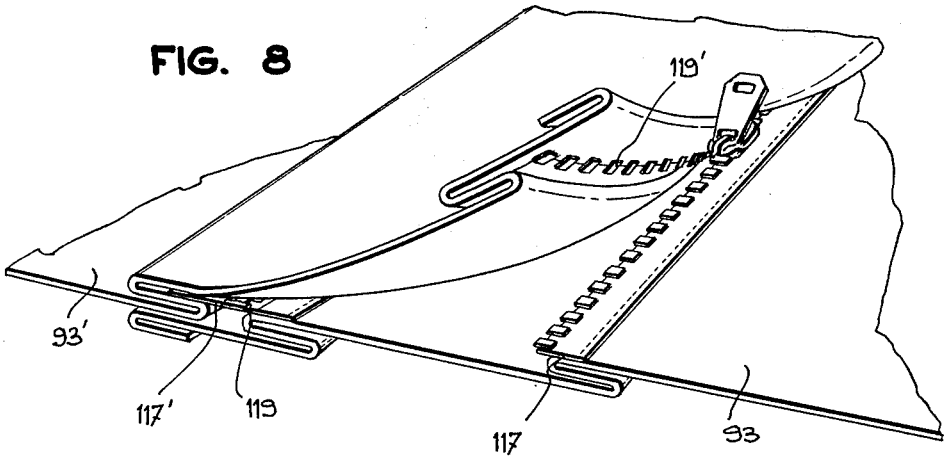
FIG. 8 is a perspective view of a system for joining the wide sheets forming the double roof.

Referring now to FIGS. 6, 7 and 8, the removable roof 87 is, in fact, a double sealing roof made up of two wide sheets of flexible material secured to the modules in a removable and rapid manner in order to cover the full length of the hallway.

The first wide sheet of flexible material making up the double roof has generally the same width as that of the hallway and is preferably constituted by a plastic sheet 91 drawn between the upper ends of the front walls 19 of the base modules 3. The second wide sheet of flexible sealing material forming the double roof has a width which is greater than that of the hallway and is preferably constituted by another plastic sheet 93 drawn above the first sheet 91 between the top walls 11 of the base modules 3.

In order to ensure gravity flow of rain water or of snow falling on the double roof on either side of the hallway 9, the sheet 93 making up the second sheet of the double roof is placed on a row of bows 95 intended to provide a certain curvature. The bows 95 may simply be made up of tubes secured to the lintels 27 of the base modules by simply fitting their ends into appropriate cylindrical holes 97 provided for that purpose. The bows 95 are of course spaced from one another sufficiently to ensure proper support for the sheet 93.

Sheets 91 and 93 are secured to the base modules 3 and to the vestibule modules 7 by means of a simple and rapidly set up fastening system as described above, using laces and hooks or eyelets.

Thus, the sheet 93 is secured behind the lintels 27 of the base modules by means of extruded aluminum shapes 101 provided with hooks 103, the shapes being secured behind the lintels 27. Other hooks or eyelets 99 are provided along the edges of the sheet 93 which is joined to the shapes 101 by means of a lace 105 drawn in zigzag between the hooks 103 and the hooks or eyelets 99. Obviously, in order to provide proper sealing, it is necessary that the sheet 93 be sufficiently wide and sufficiently drawn so that its edges cover up and protect completely the upper surface of the lintels 27 of the base modules to avoid water infiltration into the hallway.

In a similar manner, the sheet 91 is secured to a board 89 (FIG. 7) rigidly fixed near the top of the sidewalls 19 of the base modules, by means of extruded aluminum strips 109 having hooks 111 and secured to the board 89. Other hooks or eyelets 107 are provided on the sheet 91 which is connected to the strips 109 by means of a lace 113 drawn in zigzag between the hooks 111 and the hooks or eyelets 107. In order to complete the insulation of the double roof, the edges of the inner sheet 91 may be provided with an adhesive strip 115 of the VELCRO type that may be pressed against another similar strip 117 of the same type secured to the board 89 once the lace 113 has been drawn. In order to allow a certain clearance in securing the sheet 91, one or more strips 115', parallel to strip 115, may be provided of which the use will be exactly the same but which will provide one or more extra inches of width, if need be.

The sheets 91 and 93 are secured to the modules 7 in the same manner as to the modules 3, by means of a like fastening system.

In order to allow the sheets 91 and 93 a certain clearance when the temporary shelter is set up, a joint such as illustrated in FIG. 8 may be provided. This joint consists of two slide fasteners 117 and 119 sewn in parallel a few inches apart. This arrangement makes it possible indeed to obtain perfect sealing of the joint and, as the case may be, provide for the sheet to be enlarged or shortened. In order that the hallway be more pleasant, transparent or translucent plastic sheets will preferably be used to allow light to pass therethrough.

As can be seen, the above-described temporary shelter may be assembled very simply and rapidly on any selected site without requiring skilled labor. Each module may easily be shipped by aircraft, helicopter or truck and is conceived to be immediately usable which, of course, minimizes the installation cost and improves the working conditions. The use of flexible sheets makes it possible to obtain joints that not only provide adequate sealing but are capable of resisting deformation or distortion of the assembly and may be corrected if need be. These joints being easily taken apart, the modules may very easily be recuperated for later use when the exploration requires it.

It is of course to be understood that the invention is not limited to the foregoing description of a particular embodiment but has a wider scope which is defined in the appended claims.

I claim:

1. Method for the construction of a temporary shelter by the simple and fast assembly, on a selected site, of a set of easily transportable modular elements comprising an even number of shelter base modules of equal size each having an entrance at one end, at least one floor module and two vestibule-forming modules having the same width as that of the floor module, said method comprising:

(a) placing the base modules side by side in two rows with the base modules of one row facing, in pairs, those of the other row so as to form a hallway and at a distance equal to the width of said floor module, said entrances opening into said hallway;

(b) placing each floor module between one pair of facing modules so as to join said facing modules at the base thereof;

(c) placing said vestibule modules at the ends of said hallway so as to close it;

(d) joining adjacent base modules of each row by means of a thin sheet of flexible sealing material removably secured to the front, top and back walls of each base module;

(e) forming a double sealing roof over the full length of said hallway by removably securing a first wide sheet of flexible material having substantially the width of said hallway, this first sheet spreading over said hallway between the upper ends of said front walls of said base modules, and a second wide sheet of flexible sealing material having a width greater than that of said hallway, said second sheet spreading above said first sheet between said top walls of said base modules whereby to sealingly insulate said hallway, and (f) joining said vestibule modules to the base modules and to the double sealing roof at the ends of the hallway by means of thin sheets in the same manner as each pair of base modules have been joined.

2. A method as claimed in claim 1, wherein, prior to securing said second wide sheet of said double sealing roof, a row of equally spaced bows are disposed above said hallway, between the ends of the top walls of said base modules facing one another, and wherein said second wide sheet is placed on said bows before it is secured so as to allow gravity flowing of rain water or snow falling on the double sealing roof on either side of said hallway.

3. A method as claimed in claim 2, including securing said thin sheets joining said base modules and said vestibule modules and said larger sheets of said double sealing roof by means of laces winding about hooks provided on said base modules and on said vestibule modules.

4. A method as claimed in claim 3, wherein said thin and larger sheets each have one row of eyelets distributed over the full length of each of the borders thereof for the reception of said laces and wherein the number of hooks provided on the base modules and on the vestibule modules corresponds to the number of eyelets in each row.

5. A method as claimed in claim 4, including securing shimming slats near the hooks of said base modules and of said vestibule modules slightly to raise said thin sheets and thus avoid rain infiltration.

6. A method as claimed in claim 5, including completing the double sealing roof by retaining the edges of the first wide sheet in contact with the front walls of said base modules by means of adhesive strips.

7. A method as claimed in claims 1, 2 or 5, including setting the base modules and the vestibule modules on two rows of beams laid over the ground at selected sites in order that said modules stand up from the ground.

8. A temporary shelter obtained by assembling, on a selected site, a set of easily transportable modular elements, said shelter comprising:

(a) an even number of base modules of equal size each having an entrance at one end, said base modules being placed side by side in two rows with the base modules of one row facing, in pairs, those of the other row so as to form a hallway, said entrances opening into said hallway;

(b) at least one floor module having the same width as said hallway, each floor module being placed between each pair of facing base modules so as to join said facing modules at the base thereof;

(c) two vestibule-forming modules having substantially the same width as each floor module, said vestibule modules being placed at the ends of said hallway so as to close it;

(d) a first set of thin sheets of flexible sealing material each removably secured between the front, the top and the rear walls of said base modules so as to join them together;

(e) a double sealing roof removably secured over the hallway along the full length thereof, said double roof comprising: a first wide sheet of flexible material having substantially the width of said hallway and spreading thereabove between the upper ends of the front walls of said base modules, and a second wide sheet of flexible sealing material having a width greater than that of said hallway and spreading between the top walls of said base modules in order to sealingly insulate said hallway, and (f) a second set of thin sheets of flexible sealing material removably secured to said base modules and to said vestibule modules so as to join them together.

9. A temporary shelter as claimed in claim 8, further comprising a row of equally spaced bows provided above said hallway between the top walls of said facing base modules and wherein the second wide sheet of said double roof passes over said bows whereby to allow gravity flow of rain water and of snow.

10. A temporary shelter as claimed in claim 9, wherein said base modules and said vestibule modules comprise hooks and wherein the thin sheets serving to join the base modules and the vestibule modules and the wide sheets forming the double roof are secured by laces wound about said hooks.

11. A temporary shelter as claimed in claim 10, wherein said thin sheets and said wide sheets are provided with eyelets over the full length of the borders thereof for the reception of said laces and wherein the number of hooks on the base modules and the vestibule modules correspond in number to the eyelets on each sheet.

12. A temporary shelter as claimed in claim 11, wherein the base modules and the vestibule modules comprise shimming slats near said hooks whereby to allow raising of said thin sheets to avoid water infiltration.

13. A temporary shelter as claimed in claim 12, wherein the edges of the first wide sheet of said double roof are held in contact with the front walls of the base modules by means of adhesive strips.

14. A temporary shelter as claimed in claims 8, 9 or 13, wherein the thin and the wide sheets are made of plastics material.

15. A temporary shelter as claimed in claims 8, 9 or 13, further comprising two rows of beams provided on the selected sites and on the ground and wherein the base modules and the vestibule modules are set on said beams.

* * * * *